US007389951B2

(12) United States Patent
Feldman et al.

(10) Patent No.: US 7,389,951 B2
(45) Date of Patent: Jun. 24, 2008

(54) MISTING DEVICE

(76) Inventors: Viktor Feldman, Umlassungsslr, 42, Magdeburg (DE) 39124; Alex Gubenko, 25 Fuschia, Irvine, CA (US) 92604

( * ) Notice: Subject to any disclaimer, the term of this patent is extended or adjusted under 35 U.S.C. 154(b) by 0 days.

(21) Appl. No.: 11/537,120

(22) Filed: Sep. 29, 2006

(65) Prior Publication Data

US 2007/0075165 A1 Apr. 5, 2007

Related U.S. Application Data

(60) Provisional application No. 60/722,395, filed on Oct. 1, 2005.

(51) Int. Cl.
*B05B 1/26* (2006.01)

(52) U.S. Cl. ..... 239/543; 239/404; 239/433; 239/457; 239/460; 239/463; 239/487; 239/489; 239/518; 239/544; 239/567

(58) Field of Classification Search ..... 239/403, 239/404, 418, 433, 457, 460, 461, 463, 487, 239/489, 543, 544, 518, 567
See application file for complete search history.

(56) References Cited

U.S. PATENT DOCUMENTS

| | | | | | |
|---|---|---|---|---|---|
| 1,496,645 | A | * | 6/1924 | Kaufmann | 239/460 |
| 2,025,953 | A | * | 12/1935 | Merchaut | 239/460 |
| 2,085,854 | A | * | 7/1937 | Hathaway et al. | 239/567 |
| 2,125,978 | A | * | 8/1938 | Arbogast | 239/460 |
| 2,235,258 | A | | 3/1941 | Jones | |
| 2,935,265 | A | * | 5/1960 | Richter | 239/460 |
| 3,022,014 | A | * | 2/1962 | Young | 239/518 |
| 3,116,018 | A | * | 12/1963 | Michael | 239/543 |
| 3,130,911 | A | * | 4/1964 | Billeter | 239/487 |
| 4,176,794 | A | | 12/1979 | Allenbaugh, Jr. | |
| 4,358,058 | A | | 11/1982 | Bierman | |
| 4,697,740 | A | | 10/1987 | Ivy | |
| 5,142,713 | A | | 9/1992 | Makool | |
| 5,253,716 | A | | 10/1993 | Mitchell | |
| 5,520,331 | A | | 5/1996 | Wolfe | |
| 5,553,784 | A | * | 9/1996 | Theurer | 239/403 |
| 6,398,136 | B1 | | 6/2002 | Smith | |
| 6,834,816 | B2 | * | 12/2004 | Kah, Jr. | 239/518 |
| 6,899,289 | B2 | | 5/2005 | McCracken et al. | |

* cited by examiner

*Primary Examiner*—Steven J. Ganey
(74) *Attorney, Agent, or Firm*—David A. Belasco; Belasco Jacobs & Townsley, LLP

(57) ABSTRACT

A misting spray nozzle includes a hollow body having an interior wall descending from an upper end to a lower end. The interior wall tapers toward the lower end to form a choke. A channel section provides two fluid paths descending from an upper central aperture. A turbine is sized and shaped to fit closely within the choke and has spiral grooves on its outer surface. The turbine attaches to the body at its upper end and has a cone-shaped opening at its lower end. A conical core is sized and shaped to fit closely within the cone-shaped opening and has grooves spiraling in an opposite direction on its outer surface. The core is attached at its upper end to the turbine. The two sets of spiral grooves define a pair of intersecting fluid control paths that meet at the lower end of the body to create a dense mist.

13 Claims, 9 Drawing Sheets

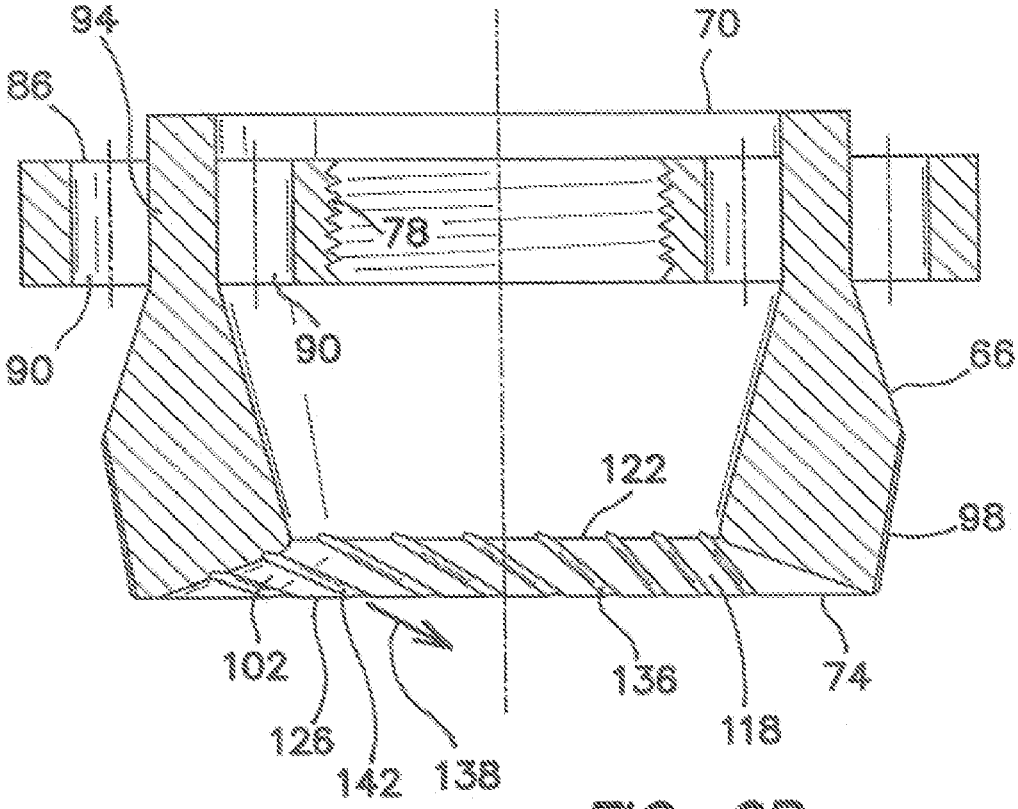
FIG. 6B
FIG. 6C
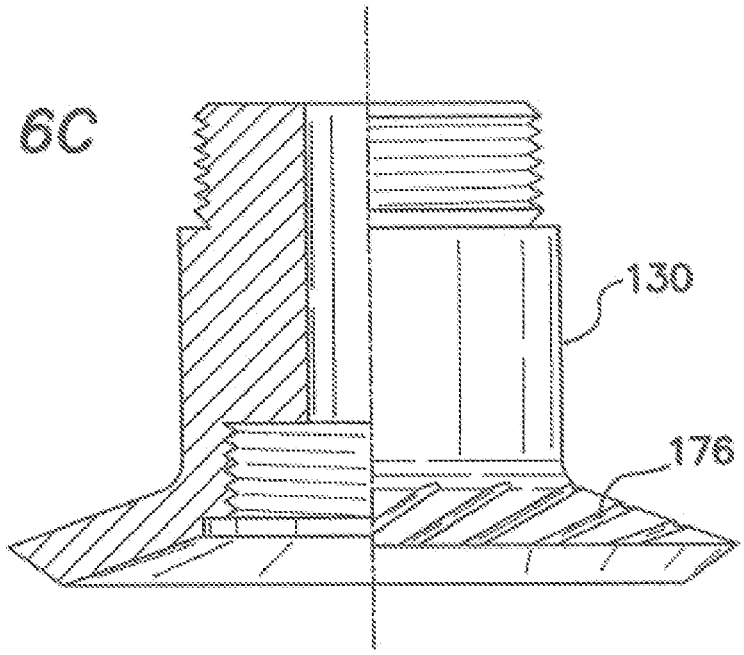

MISTING DEVICE

CROSS REFERENCE

The Applicants claim the benefit of their Provisional Application, Ser. No. 60/722,395, filed Oct. 1, 2005.

FIELD OF INVENTION

The invention pertains to apparatus for providing a mist or a fog by atomizing water or other liquids. More particularly, the invention relates to nozzles, jets and related devices for generating a dense, uniform fog layer for firefighting, metal quenching and finishing.

BACKGROUND OF THE INVENTION

Conventional firefighting techniques usually involve aiming a large volume of water at a central point in a fire in an attempt to cool the combustion below the flash point of the incendiary material. It has been found that depriving a fire of oxygen is often a more effective method of controlling a blaze. Nozzles that can produce a dense fog have been found effective in dealing with fires in this fashion. The most effective type of fogging nozzle is one that can produce a fog without any holes or pockets of air within it. Nozzles that can produce such a dense and uniform fog or mist are also useful for quenching and tempering metal and for applying paint and other finishes. The following are some examples of fogging and misting devices that have been developed.

U.S. Pat. No. 5,253,716, issued to Mitchell, is directed to a fog producing firefighting tool has a nozzle which includes a plurality of apertures oriented so that when pressurized fluid flows through each aperture, the liquid impacts at an angle of 90 degrees with another stream of liquid to atomize the liquid and create a fog. The firefighting tool is of modular construction which includes a first member, one or more intermediate members, and an end member wherein the members are connected to each other by means of quick coupler devices which can be readily locked into coupled relationship and will not interfere with the usage of the tool when it is forced into or removed from a hole in a structure.

U.S. Pat. No. 2,235,258, issued to Jones is directed to a fire extinguishing nozzle. The nozzle head includes a central pair of relatively large orifices and two pairs of relatively small orifices positioned at the sides of the central pair. Each pair is so arranged that the ejected streams of water leaving the nozzle head from each individual pair of orifices are caused to impinge together in such a way that the resulting impingement will cause the two streams of water to be broken up into a spray in which substantially all of the particles of the water are of substantially uniform size.

U.S. Pat. No. 6,398,136, issued to Smith discloses a firefighting tool incorporates a twist-lock mechanism whereby various nozzles can be interchanged for particular fire-fighting purposes. Included in such nozzles are a penetrating nozzle having a doubly beveled front end for easier access through a roof, and various fluid ejection and misting elements that can be configured in terms of fluid aperture angles to produce a mist directed somewhat back towards the user, transverse to the nozzle, or forward from the nozzle. A non-penetrating embodiment of the invention also uses an end ejecting misting region. The foregoing elements can be used in conjunction with various extension wands, which are removably connectable fluid channels bent to various angles, so as to provide easier access to fires that are located within recesses of buildings, motor vehicles, or boats and the like.

U.S. Pat. No. 5,520,331, issued to Wolfe describes a convergent/divergent gas nozzle atomizes a liquid provided through a lid delivery tube having an aperture which is centered within a central gas conduit of an upstream mixing block connected to the nozzle. The aperture of the liquid delivery tube is located just upstream of a narrowed throat of the nozzle. The throat of the nozzle is dimensioned such that its inside diameter is equal to the outside diameter of the liquid injector tube. A spout is located at the discharge end of the nozzle which has an inside diameter equal to two times the inside diameter of the throat. This nozzle displays superior performance, providing an extremely fine mist having high momentum. This nozzle is particularly well-suited to fire extinguishment.

U.S. Pat. No. 5,553,784, issued to Theurer is directed to a nozzle assembly provides a high pressure dispersion of water particles in a misting process. The nozzle includes multiple arrayed discharge outlets into a single mixing zone wherein the discharge outlets are concentrically arranged alternating between water and gas streams. The mist from the novel arrangement is highly dispersed, providing excellent gas cooling operation with minimal maintenance.

It is an objective of the present invention to provide a misting or fogging device capable of a dense and uniform mist. It is a further objective to such a device be compatible with existing fire sprinkler systems in terms of required pressure and fire sensing activators. It is yet a further objective of the invention to provide a device suitable for point dispersion and another device capable of lateral dispersion. It is still a further objective to provide devices suitable for metal quenching and for surface finishing such as painting. Finally, it is an objective to provide a misting or fogging device that is simple and inexpensive to produce while fulfilling all of the described performance criteria.

While some of the objectives of the present invention are disclosed in the prior art, none of the inventions found include all of the requirements identified.

SUMMARY OF THE INVENTION

The present invention addresses all of the deficiencies of prior art misting and fogging inventions and satisfies all of the objectives described above.

(1) A misting device providing all of the desired capabilities can be constructed from the following components. A body is provided. The body has a cylindrical interior space, a first end, a second end, means for attaching the body at the first end to a fluid supply, an internal attachment means adjacent the first end. The body has a first opening at the first end of a first predetermined diameter, an interior wall descending from the first opening toward the second end. The wall tapers inwardly to form a choke portion from a point spaced from the first end to the second end and terminating at a second opening of a second, smaller predetermined diameter.

A turbine is provided. The turbine has a cylindrical shape, an upper end and a lower end, a central attachment means, a mating external attachment means for attaching to the body and a channel portion. The channel portion provides at least two fluid channels and supports a fluid directing portion. The fluid directing portion has an external surface and an internal surface. The external surface is sized and shaped to fit closely adjacent to the choke portion. The external surface has at least one first downwardly angled spiral groove. The first groove spirals in a first direction, thereby defining a first spiraling channel. The internal surface forms a cone-shaped chamber. The chamber has a first smaller end and a second larger end adjacent the lower end.

A core is provided. The core has a truncated cone shape and is sized and shaped to fit closely adjacent to the cone-shaped chamber. The core attaches to the central attachment means and has at least one second downwardly angled spiral groove. The second groove spirals in a second, opposite direction, thereby defining a second spiraling channel. The body is attached to the fluid supply, the turbine attached to the body and the core attached to the turbine. Fluid is provided. The fluid is supplied to the first end of the body at a predetermined pressure.

When the fluid is supplied to the body at the predetermined pressure it is routed through the channel portion of the turbine and broken into two streams, a first stream directed to the first spiraling channel and spiraled in a first direction, and a second stream directed to the second spiraling channel and spiraled in a second direction. The first and second streams intersect at the second end of the body and atomize into a mist.

(2) In a variant of the invention, the choke portion further includes at least one downwardly angled spiral groove.

(3) In another variant, the cone-shaped chamber further includes at least one downwardly angled spiral groove.

(4) A misting device providing all of the desired capabilities can be constructed from the following components. A body is provided. The body has a cylindrical interior space, a first end, a second end, means for attaching the body at the first end to a fluid supply, an internal attachment means adjacent the first end. The body has a first opening at the first end of a first predetermined diameter, an interior wall descending from the first opening toward the second end. The wall tapers inwardly to form a choke portion from a point spaced from the first end to the second end and terminating at a second opening of a second, smaller predetermined diameter.

A turbine is provided. The turbine has a cylindrical shape, an upper end and a lower end, a central attachment means, a mating external attachment means for attaching to the body and a channel portion. The channel portion provides at least two fluid channels and supports a fluid directing portion. The fluid directing portion has an external surface and an internal surface. The external surface is sized and shaped to fit closely adjacent to the choke portion. The external surface has at least one first downwardly angled spiral groove. The first groove spirals in a first direction, thereby defining a first spiraling channel. The internal surface forms a cone-shaped chamber. The chamber has a first smaller end and a second larger end adjacent the lower end and has at least one second downwardly angled spiral groove. The second groove spirals in a second, opposite direction, thereby defining a second spiraling channel.

A core is provided. The core has a truncated cone shape and is sized and shaped to fit closely adjacent to the cone-shaped chamber. The core attaches to the central attachment means. The body is attached to the fluid supply, the turbine attached to the body and the core attached to the turbine. Fluid is provided. The fluid is supplied to the first end of the body at a predetermined pressure.

When the fluid is supplied to the body at the predetermined pressure it is routed through the channel portion of the turbine and broken into two streams, a first stream directed to the first spiraling channel and spiraled in a first direction, and a second stream directed to the second spiraling channel and spiraled in a second direction. The first and second streams intersect at the second end of the body and atomize into a mist.

(5) In a variant of the invention, the choke portion further includes at least one downwardly angled spiral groove.

(6) In another variant, the core further includes at least one downwardly angled spiral groove.

(7) In still another variant, the first groove is angled at from 0 degrees to 180 degrees to the second end of the body.

(8) In yet another variant, the second groove is angled at from 0 degrees to 180 degrees to the second end of the body.

(9) In a further variant, the angle between the first groove and the second groove is 90 degrees.

(10) In still a further variant, the angle between the first groove and the second groove ranges from 0 degrees to 180 degrees.

(11) In another variant of the invention, the distance between the choke portion and the external surface of the turbine ranges from 0.001 mm to 5 mm.

(12) In still another variant, the distance between the cone-shaped chamber and the core ranges from 0.001 mm to 5 mm.

(13) In yet a further variant, a lateral misting device includes a hollow body. The body has a flattened rectangular shape, a top edge, first and second bottom edges, first and second side edges, an interior chamber, first and second interior walls and a fluid inlet connector located adjacent to the top edge. A divider plate is provided. The divider plate is sized and shaped to fit between the first and second interior walls and has first and second sides. Each of the sides has at least one downwardly spiraling groove. The at least one groove on the first side spiraling in a first direction and the at least one groove on the second side spiraling in an opposite, second direction.

The divider plate is attached between the first and second interior walls and divides a path from the fluid inlet connector into two pathways. Each of the first and second bottom edges angles inwardly toward the divider plate and forms a channel. The channel is directed at the channel formed on an opposite side of the divider plate. Fluid is provided. The fluid is supplied to the fluid inlet connector at a predetermined pressure. When the fluid is introduced to the fluid inlet connector it will be divided into first and second streams. The first stream is directed between the first interior wall and the divider plate and is spiraled in a first direction. The second stream is directed between the second interior wall and the divider plate and is spiraled in a second, opposite direction. The first stream impinges upon the second stream at the bottom edges of the body and produces a mist with a lateral dispersion.

An appreciation of the other aims and objectives of the present invention and an understanding of it may be achieved by referring to the accompanying drawings and the detailed description of a preferred embodiment.

BRIEF DESCRIPTION OF THE DRAWINGS

FIG. 6B is a partial cross-sectional side elevation of the turbine of the FIG. 6 embodiment, illustrating the first set of spiral grooves and an additional set of spiral grooves in the interior for the cone-shaped chamber; and FIG. 6C is a partial cross-sectional side elevation of the core of the FIG. 6 embodiment illustrating its smooth upper surface.

Figure 1:
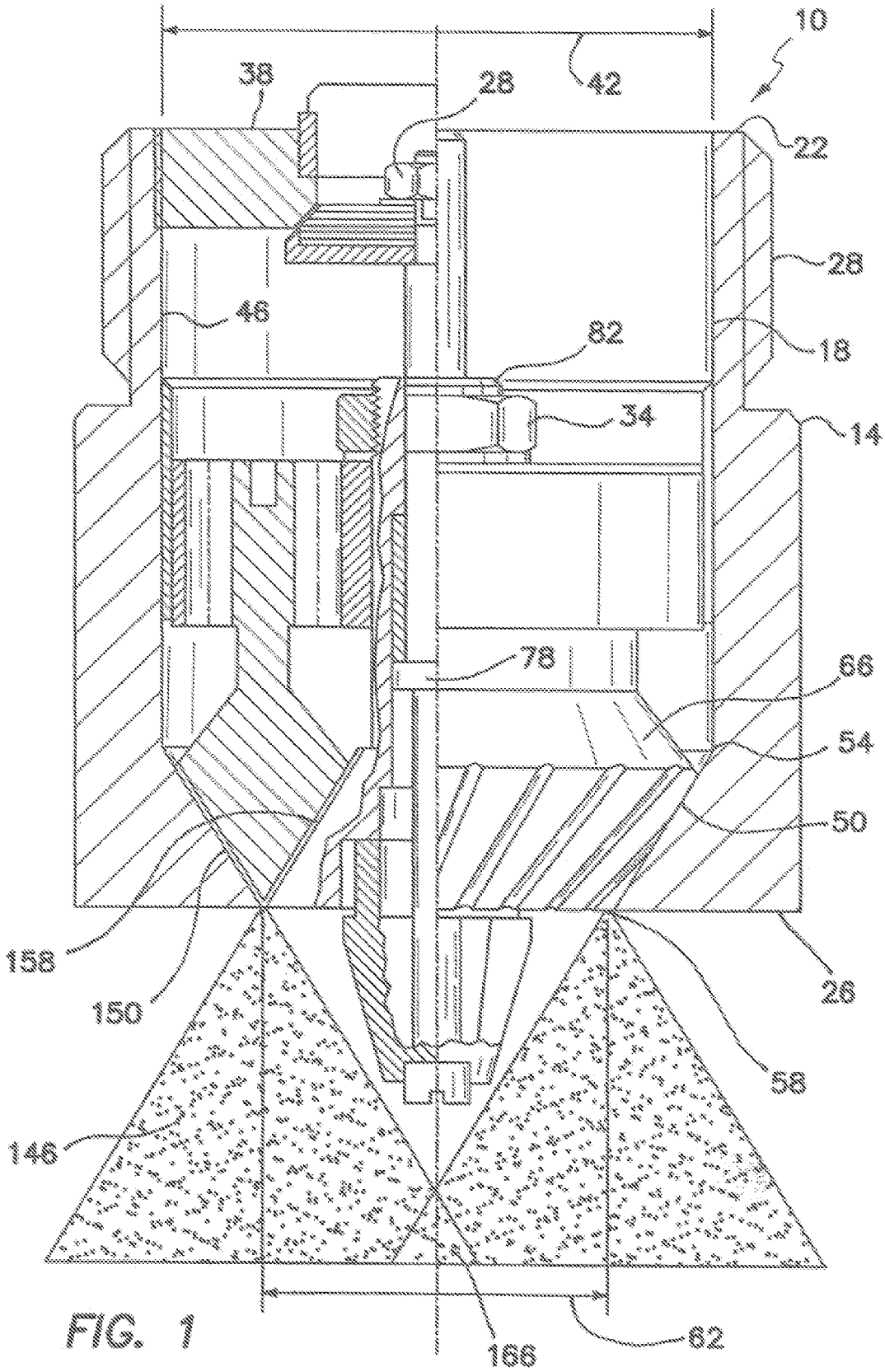
FIG. 1 is a cross-sectional side elevation of the preferred embodiment of a round pattern misting device, illustrating two intersecting spiral fluid paths.

DETAILED DESCRIPTION OF THE PREFERRED EMBODIMENTS (1) A misting device 10, as illustrated in FIGS. 1-3 and 5, providing all of the desired capabilities can be constructed from the following components. A body 14 is provided. The body 14 has a substantially cylindrical interior space 18, a first end 22, a second end 26, means 28 for attaching the body 14 at the first end 22 to a fluid supply (not shown), an internal attachment means 34 adjacent the first end 22. The body 14 has a first opening 38 at the first end 22 of a first predetermined diameter 42, an interior wall 46 descending from the first opening 38 toward the second end 26. The wall 46 tapers inwardly to form a choke portion 50 from a point 54 spaced from the first end 22 to the second end 26 and terminating at a second opening 58 of a second, smaller predetermined diameter 62.

Figure 2:
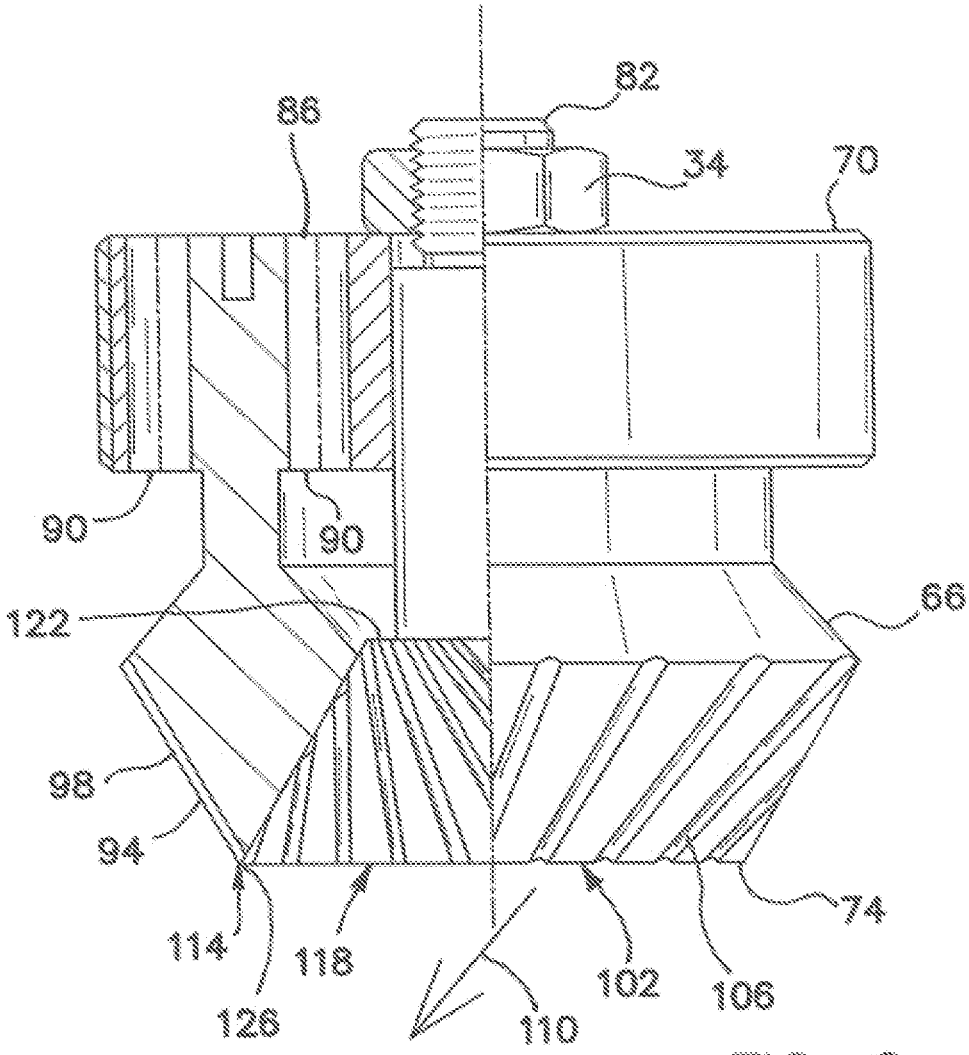
FIG. 2 is a partial cross-sectional side elevation of the turbine of the FIG. 1 embodiment, illustrating a first set of spiral grooves and a smooth interior for the cone-shaped chamber.

A turbine 66, as illustrated in FIG. 2, is provided. The turbine 66 has a substantially cylindrical shape, an upper end 70 and a lower end 74, a central attachment means 78, a mating external attachment means 82 for attaching to the body 14 and a channel portion 86. The channel portion 86 provides at least two fluid channels 90 and supports a fluid directing portion 94. The fluid directing portion 94 has an external surface 98 and an internal surface 102. The external surface 98 is sized and shaped to fit closely adjacent to the choke portion 50. The external surface 98 has at least one first downwardly angled spiral groove 106. The first groove 106 spirals in a first direction 110, thereby defining a first spiraling channel 114. The internal surface 102 forms a cone-shaped chamber 118. The chamber 118 has a first smaller end 122 and a second larger end 126 adjacent the lower end 74.

Figure 3:
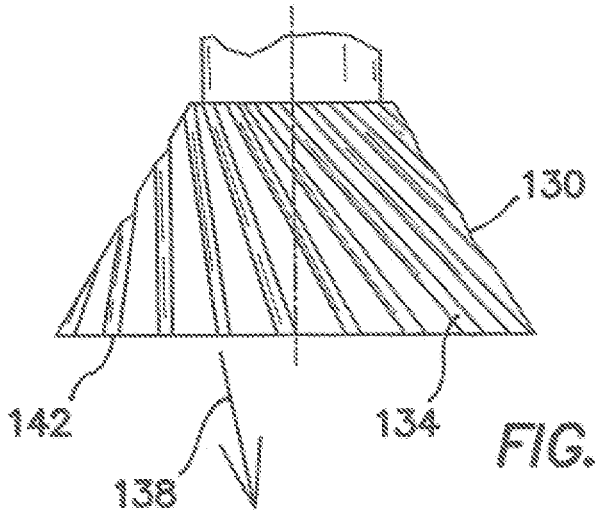
FIG. 3 is side elevation of the core of the FIG. 1 embodiment illustrating a second set of spiral grooves.

A core 130, as illustrated in FIG. 3, is provided. The core 130 has a truncated cone shape and is sized and shaped to fit closely adjacent to the cone-shaped chamber 118. The core 130 attaches to the central attachment means 78 and has at least one second downwardly angled spiral groove 134. The second groove 134 spirals in a second, opposite direction 138, thereby defining a second spiraling channel 142. The body 14 is attached to the fluid supply, the turbine 66 attached to the body 14 and the core 130 attached to the turbine 66. Fluid 146 is provided. The fluid 146 is supplied to the first end 22 of the body 14 at a predetermined pressure.

When the fluid 146 is supplied to the body 14 at the predetermined pressure it is routed through the channel portion 86 of the turbine 66 and broken into two streams, a first stream 150 directed to the first spiraling channel 114 and spiraled in a first direction 154, and a second stream 158 directed to the second spiraling channel 142 and spiraled in a second direction 162. The first 150 and second 158 streams intersect at the second end 26 of the body 14 and atomize into a mist 166.

Figure 1A:
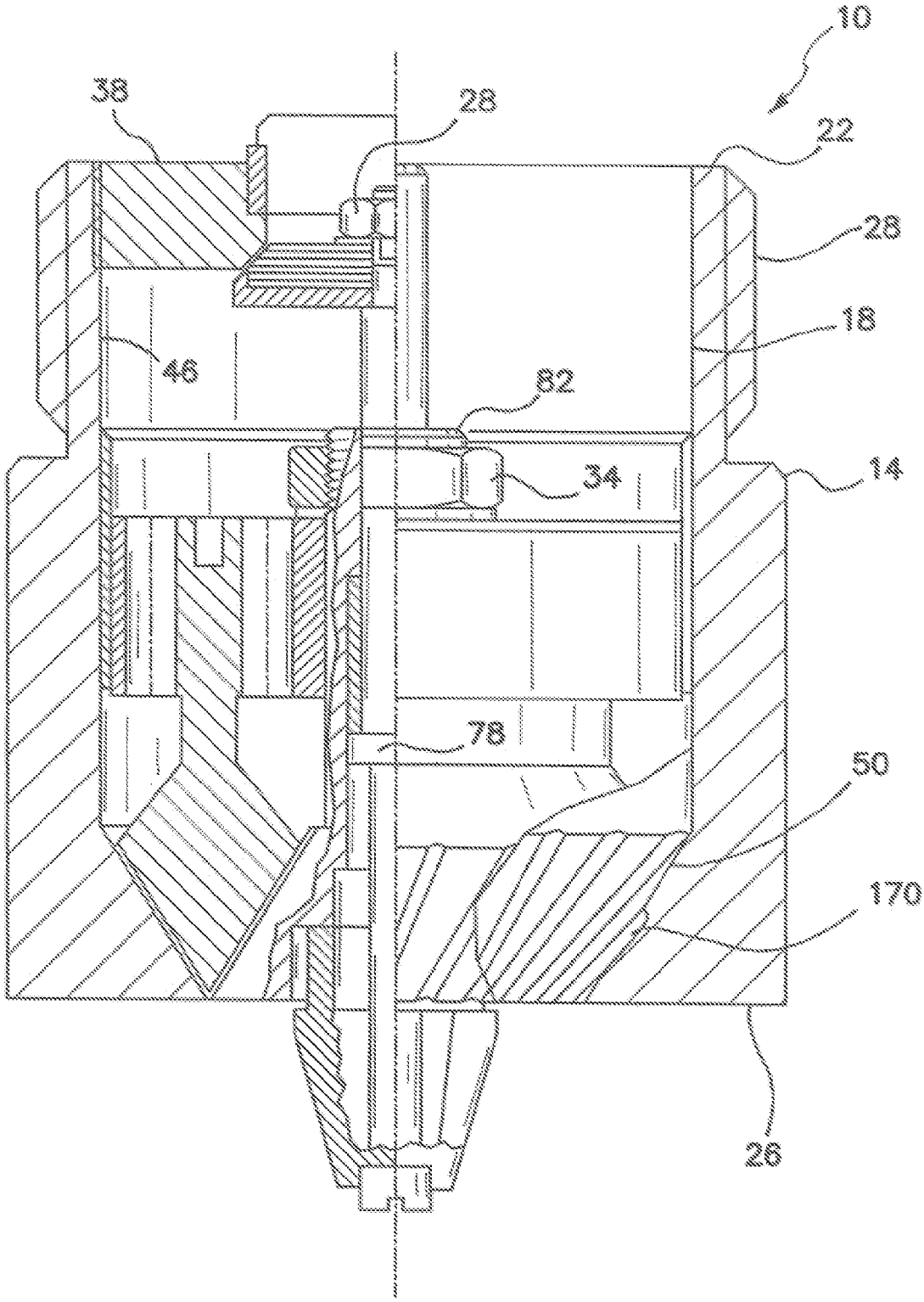
FIG. 1A is a cross-sectional side elevation of the FIG. 1 embodiment illustrating additional spiral channels cut into the inner surface of the body.

(2) In a variant of the invention, as illustrated in FIG. 1A, the choke portion 50 further includes at least one downwardly angled spiral groove 170.

Figure 2A:
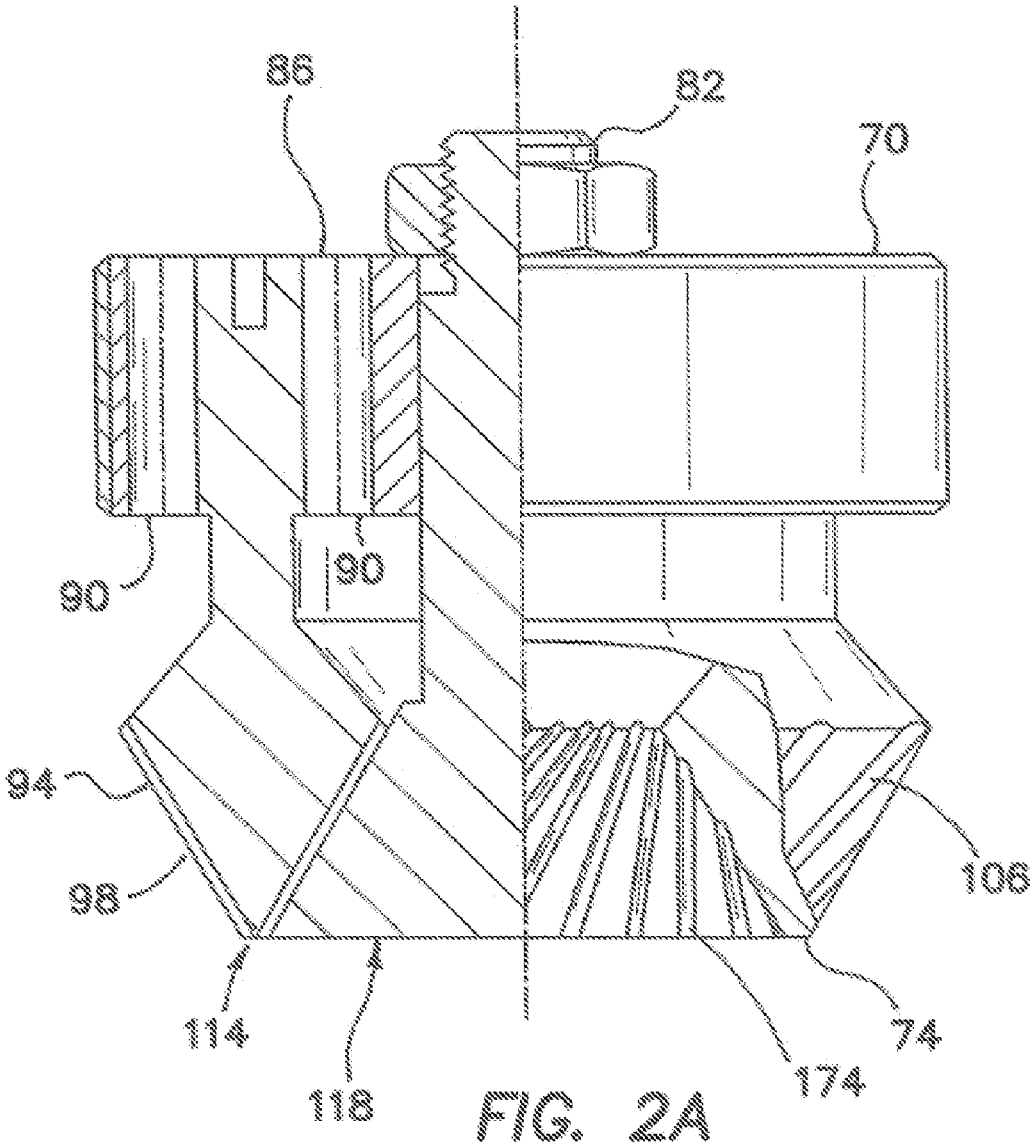
FIG. 2A is a partial cross-sectional side elevation of the turbine of the FIG. 1 embodiment, illustrating the first set of spiral grooves and an additional set of spiral grooves in the interior for the cone-shaped chamber.
Figure 3A:
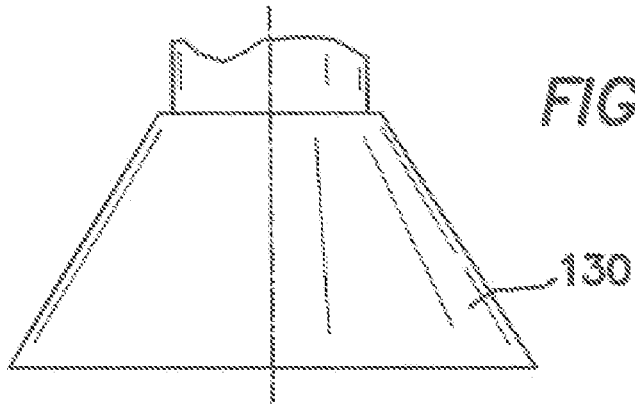
FIG. 3A is side elevation of the core of the FIG. 1 embodiment without a second set of spiral grooves.
Figure 4:
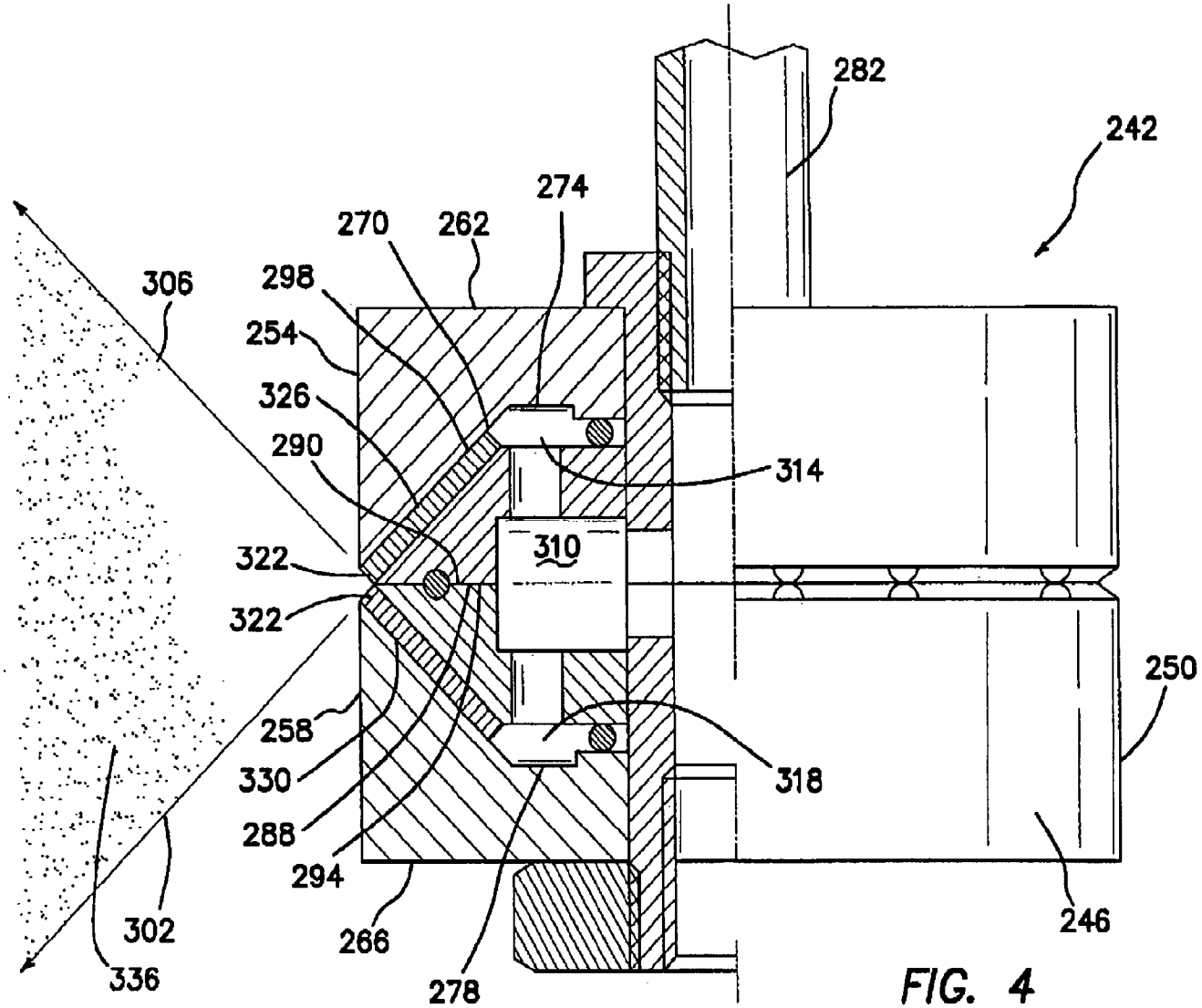
FIG. 4 is a partial cross-sectional side elevation view of a flat pattern sprayer.
Figure 5:
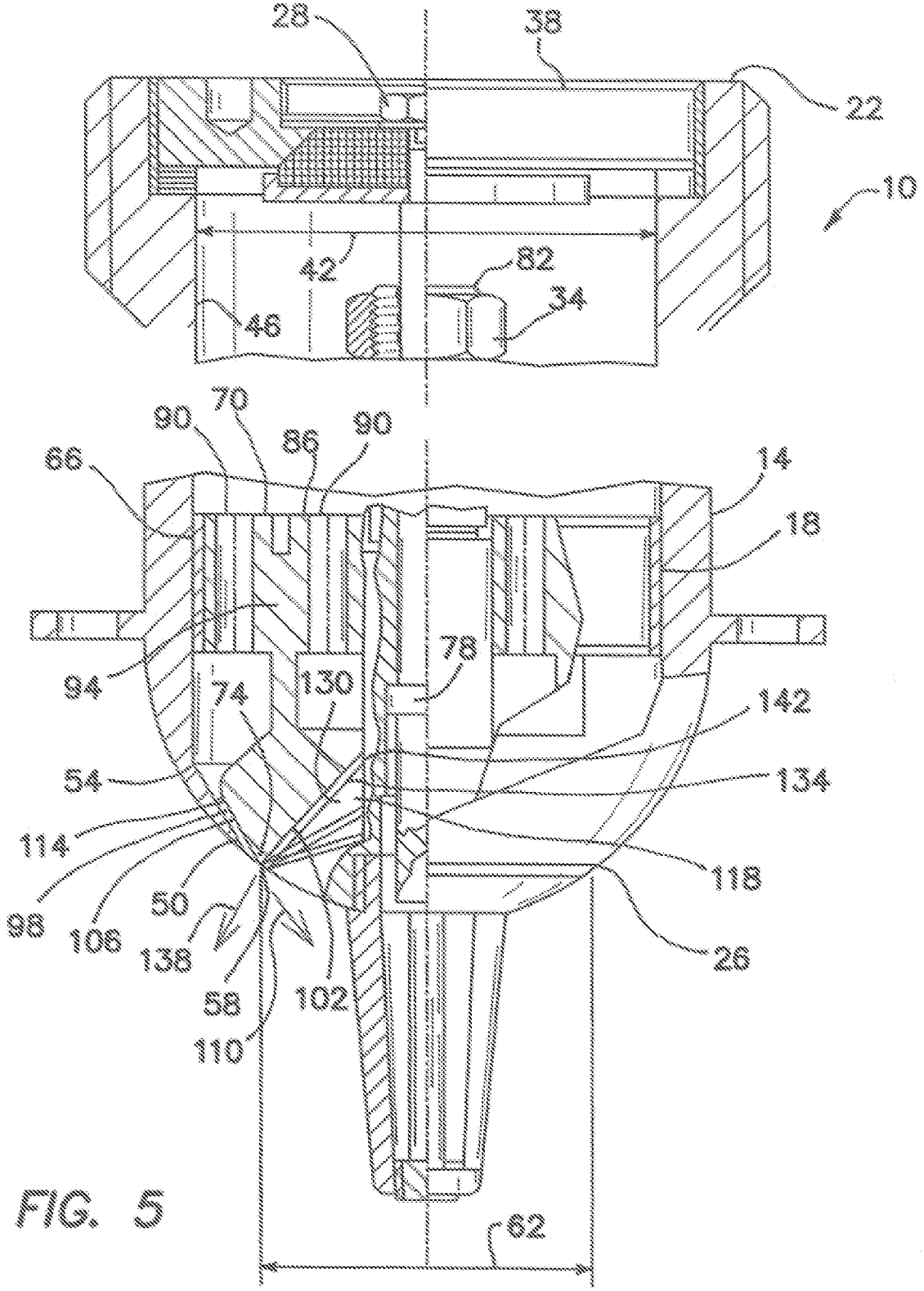
FIG. 5 is a partial cross-sectional side elevation view of a second design for a round pattern misting device.

(3) In another variant, as illustrated in FIG. 2A, the cone-shaped chamber 118 further includes at least one downwardly angled spiral groove 174.

Figure 6:
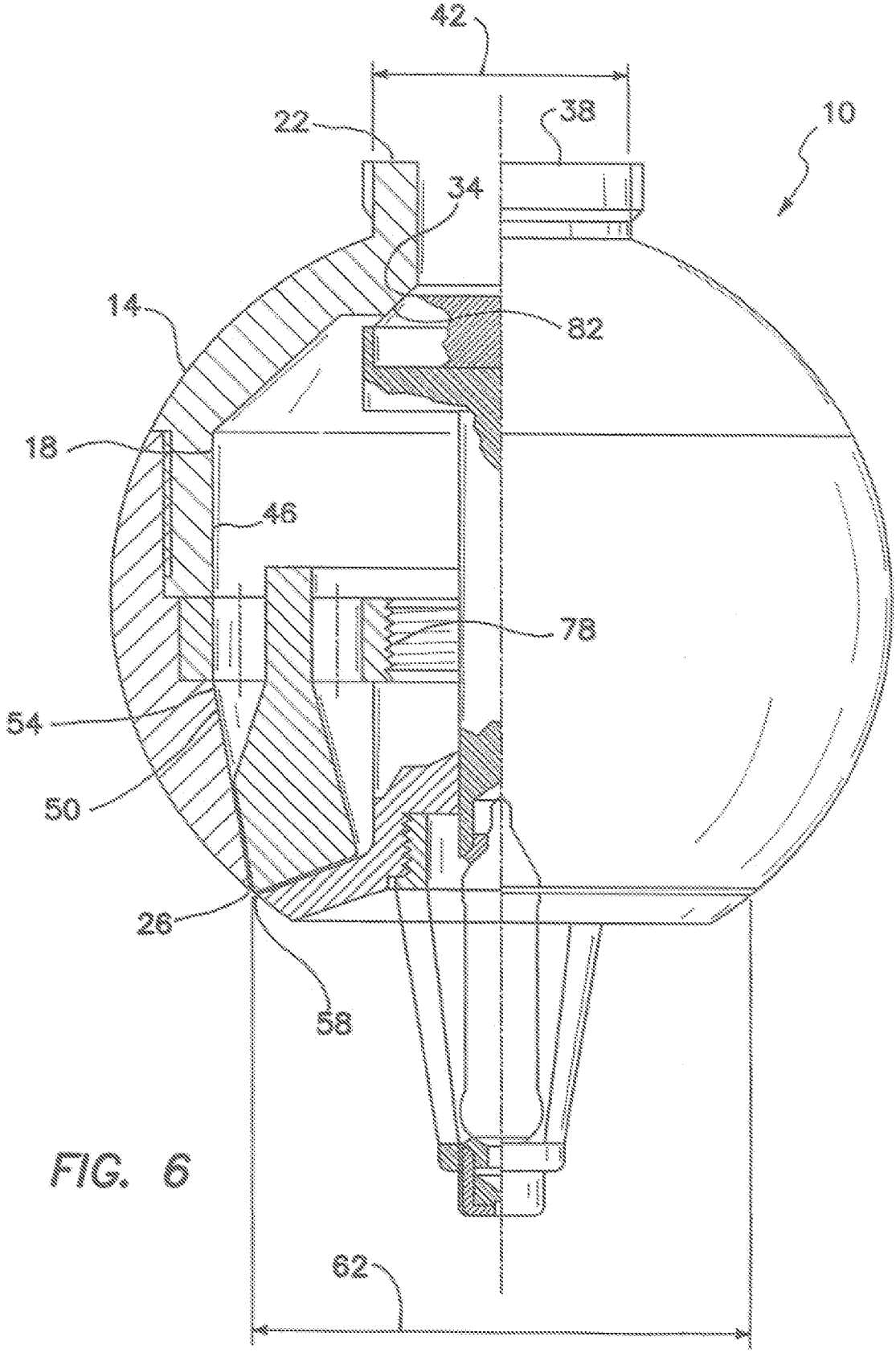
FIG. 6 is a partial cross-sectional side elevation view of a third design for a round pattern misting device.

(4) A misting device 10, as illustrated in FIGS. 6-6C, providing all of the desired capabilities can be constructed from the following components. A body 14 is provided. The body 14 has a cylindrical interior space 18, a first end 22, a second end 26, means (not shown), for attaching the body 14 at the first end 22 to a fluid supply (not shown), an internal attachment means 34 adjacent the first end 22. The body 14 has a first opening 38 at the first end 22 of a first predetermined diameter 42, an interior wall 46 descending from the first opening 38 toward the second end 26. The wall 46 tapers inwardly to form a choke portion 50 from a point 54 spaced from the first end 22 to the second end 26 and terminating at a second opening 58 of a second, smaller predetermined diameter 62.

Figure 6A:
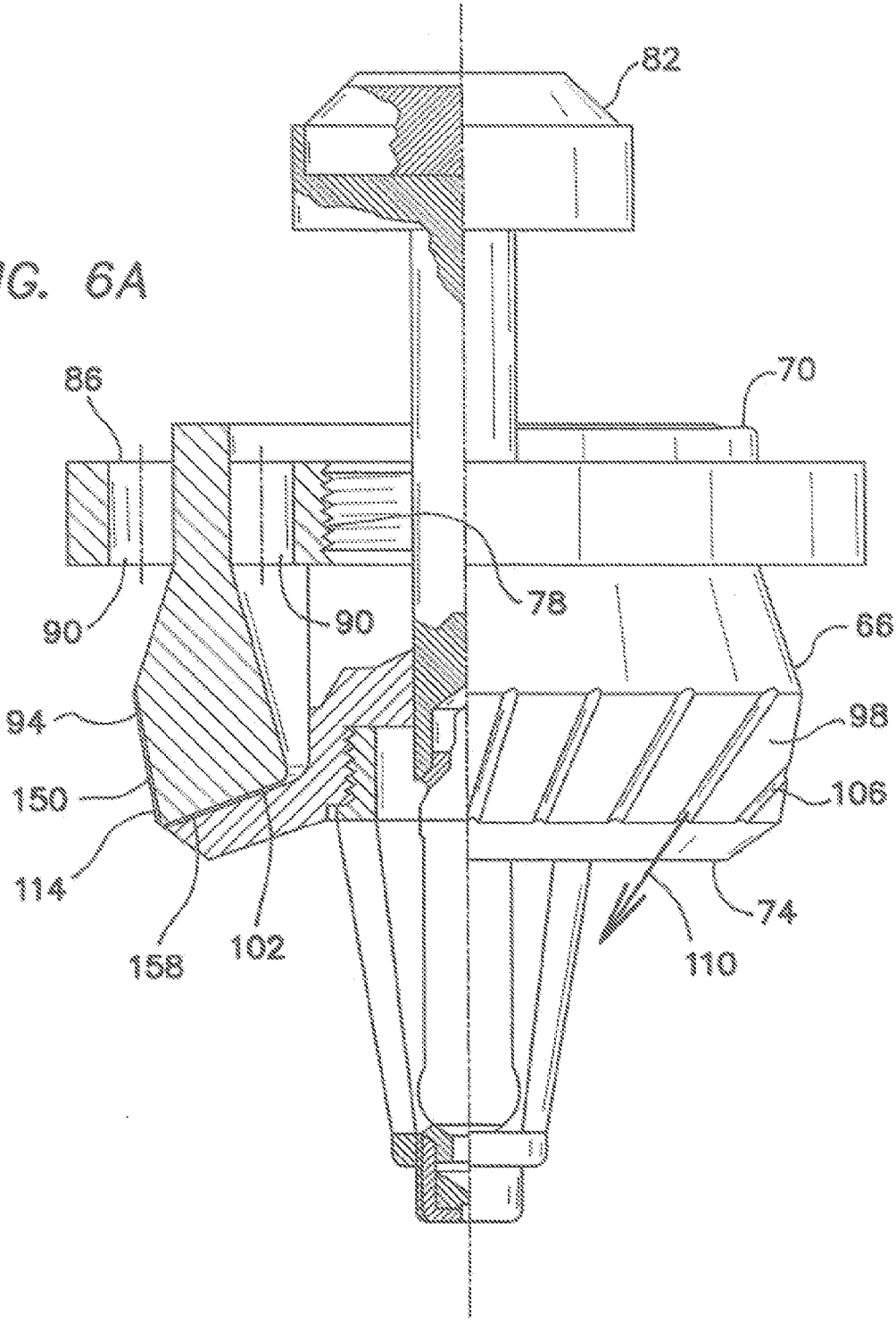
FIG. 6A is partial a cross-sectional side elevation of the turbine and the core of the FIG. 6 embodiment, illustrating the first set of spiral grooves on the outer surface of the turbine.

A turbine 66, as illustrated in FIGS. 6A and 6B, is provided. The turbine 66 has a cylindrical shape, an upper end 70 and a lower end 74, a central attachment means 78, a mating external attachment means 82 for attaching to the body 14 and a channel portion 86. The channel portion 86 provides at least two fluid channels 90 and supports a fluid directing portion 94. The fluid directing portion 94 has an external surface 98 and an internal surface 102. The external surface 98 is sized and shaped to fit closely adjacent to the choke portion 50. The external surface 98 has at least one first downwardly angled spiral groove 106. The first groove 106 spirals in a first direction 110, thereby defining a first spiraling channel 114. The internal surface 102 forms a cone-shaped chamber 118. The chamber 118 has a first smaller end 122 and a second larger end 126 adjacent the lower end 74 and has at least one second downwardly angled spiral groove 136. The second groove 136 spirals in a second, opposite direction 138, thereby defining a second spiraling channel 142.

A core 130, as illustrated in FIG. 6C, is provided. The core 130 has a truncated cone shape and is sized and shaped to fit closely adjacent to the cone-shaped chamber 118. The core 130 attaches to the central attachment means 78. The body 14 is attached to the fluid supply 30, the turbine 66 attached to the body 14 and the core 130 attached to the turbine 66. Fluid (not shown), is provided. The fluid is supplied to the first end 22 of the body 14 at a predetermined pressure.

When the fluid is supplied to the body 14 at the predetermined pressure it is routed through the channel portion 86 of the turbine 66 and broken into two streams, a first stream 150 directed to the first spiraling channel 114 and spiraled in a first direction 110, and a second stream 158 directed to the second spiraling channel 142 and spiraled in a second direction 138. The first 150 and second 158 streams intersect at the second end 26 of the body 14 and atomize into a mist 166.

(5) In a variant of the invention, the choke portion 50 further includes at least one downwardly angled spiral groove (not shown).

(6) In another variant, as illustrated in FIG. 6C, the core 130 further includes at least one downwardly angled spiral groove 176.

(7) In still another variant, the first groove 106 is angled at from 0 degrees to 180 degrees to the second end 26 of the body 14.

(8) In yet another variant, the second groove 134 is angled at from 0 degrees to 180 degrees to the second end 26 of the body 14.

(9) In a further variant, the angle 178 between the first groove 106 and the second groove 134 is 90 degrees.

(10) In still a further variant, the angle 178 between the first groove 106 and the second groove 134 ranges from 0 degrees to 180 degrees.

(11) In another variant of the invention, the distance 182 between the choke portion 50 and the external surface 98 of the turbine 66 ranges from 0.001 mm to 5 mm.

(12) In still another variant, the distance 186 between the cone-shaped chamber 118 and the core 130 ranges from 0.001 mm to 5 mm.

(13) In yet a further variant, a lateral misting device 242 includes a hollow body 246. The body 246 has a flattened rectangular shape, a top edge 250, first 254 and second 258 bottom edges, first 262 and second 266 side edges, an interior chamber 270, first 274 and second 278 interior walls and a fluid inlet connector 282 located adjacent to the top edge 250. A divider plate 286 is provided. The divider plate 286 is sized and shaped to fit between the first 274 and second 278 interior walls and has first 290 and second 294 sides. Each of the sides 290, 294 has at least one downwardly spiraling groove 298. The at least one groove 298 on the first side 290 spiraling in a first direction 302 and the at least one groove 298 on the second side 294 spiraling in an opposite, second direction 306.

The divider plate 286 is attached between the first 274 and second 278 interior walls and divides a path 310 from the fluid inlet connector 282 into two pathways 314, 318. Each of the first 254 and second 258 bottom edges angles inwardly toward the divider plate 286 and forms a channel 322. The channel 322 is directed at the channel 322 formed on an opposite side 290, 294 of the divider plate 286. Fluid 146 is provided. The fluid 146 is supplied to the fluid inlet connector 282 at a predetermined pressure. When the fluid 146 is introduced to the fluid inlet connector 282 it will be divided into first 326 and second 330 streams. The first stream 326 is directed between the first interior wall 274 and the divider plate 286 and is spiraled in a first direction 302. The second stream 330 is directed between the second interior wall 278 and the divider plate 286 and is spiraled in a second, opposite direction 306. The first stream 326 impinges upon the second stream 330 at the bottom edges 254, 258 of the body 246 and produces a mist 336 with a lateral dispersion.

The invention claimed is:

1. A misting device comprising:

a body, said body having a cylindrical interior space, a first end, a second end, means for attaching said body at said first end to a fluid supply, an internal attachment means adjacent said first end, a first opening at said first end of a first predetermined diameter, an interior wall descending from said first opening toward said second end, said wall tapering inwardly to form a choke portion from a point spaced from said first end to said second end and terminating at a second opening of a second, smaller predetermined diameter;

a turbine, said turbine having a cylindrical shape, an upper end and a lower end, a central attachment means, a mating external attachment means for attaching to said body, a channel portion, said channel portion providing at least two fluid channels and supporting a fluid directing portion;

said fluid directing portion having an external surface and an internal surface, said external surface being sized and shaped to fit closely adjacent to said choke portion, and having at least one first downwardly angled spiral groove, said first groove spiraling in a first direction, thereby defining a first spiraling channel;

said internal surface forming a cone-shaped chamber, said chamber having a first smaller end and a second larger end adjacent said lower end;

a core, said core having a truncated cone shape and being sized and shaped to fit closely adjacent to said cone-shaped chamber, attaching to said central attachment means, having at least one second downwardly angled spiral groove, said second groove spiraling in a second, opposite direction, thereby defining a second spiraling channel;

said body attached to said fluid supply, said turbine attached to said body and said core attached to said turbine;

fluid, said fluid being supplied to said first end of said body at a predetermined pressure; and whereby, when said fluid is supplied to said body at said predetermined pressure it is routed through said channel portion of said turbine and broken into two streams, a first stream directed to said first spiraling channel and spiraled in a first direction, and a second stream directed to said second spiraling channel and spiraled in a second direction, said first and second streams intersecting at said second end of said body and atomizing into a mist.

2. The misting device, as described in claim 1, wherein said choke portion further comprises at least one downwardly angled spiral groove.

3. The misting device, as described in claim 1, wherein said cone-shaped chamber further comprises at least one downwardly angled spiral groove.

4. A misting device comprising:

a body, said body having a cylindrical interior space, a first end, a second end, means for attaching said body at said first end to a fluid supply, an internal attachment means adjacent said first end, a first opening at said first end of a first predetermined diameter, an interior wall descending from said first opening toward said second end, said wall tapering inwardly to form a choke portion from a point spaced from said first end to said second end and terminating at a second opening of a second, smaller predetermined diameter;

a turbine, said turbine having a cylindrical shape, an upper end and a lower end, a central attachment means, a mating external attachment means for attaching to said body, a channel portion, said channel portion providing at least two fluid channels and supporting a fluid directing portion;

said fluid directing portion having an external surface and an internal surface, said external surface being sized and shaped to fit closely adjacent to said choke portion, and having at least one first downwardly angled spiral groove, said first groove spiraling in a first direction, thereby defining a first spiraling channel;

said internal surface forming a cone-shaped chamber, said chamber having a first smaller end and a second larger end adjacent said lower end, having at least one second downwardly angled spiral groove, said second groove spiraling in a second, opposite direction, thereby defining a second spiraling channel;

a core, said core having a truncated cone shape and being sized and shaped to fit closely adjacent to said cone-shaped chamber and attaching to said central attachment means;

said body attached to said fluid supply, said turbine attached to said body and said core attached to said turbine;

fluid, said fluid being supplied to said first end of said body at a predetermined pressure; and whereby, when said fluid is supplied to said body at said predetermined pressure it is routed through said channel portion of said turbine and broken into two streams, a first stream directed to said first spiraling channel and spiraled in a first direction, and a second stream directed to said second spiraling channel and spiraled in a second direction, said first and second streams intersecting at said second end of said body and atomizing into a mist.

5. The misting device, as described in claim 4, wherein said choke portion further comprises at least one downwardly angled spiral groove.

6. The misting device, as described in claim 4, wherein said core further comprises at least one downwardly angled spiral groove.

7. The misting device, as described in claim 1 or claim 4, wherein said first groove is angled at from 0 degrees to 180 degrees to said second end of said body.

8. The misting device, as described in claim 1 or claim 4, wherein said second groove is angled at from 0 degrees to 180 degrees to said second end of said body.

9. The misting device, as described in claim 1 or claim 4, wherein the angle between said first groove and said second groove is 90 degrees.

10. The misting device, as described in claim 1 or claim 4, wherein the angle between said first groove and said second groove ranges from 0 degrees to 180 degrees.

11. The misting device, as described in claim 1 or claim 4, wherein the distance between said choke portion and said external surface of said turbine ranges from 0.001 mm to 5 mm.

12. The misting device, as described in claim 1 or claim 4, wherein the distance between said cone-shaped chamber and said core ranges from 0.001 mm to 5 mm.

13. A lateral misting device comprising:

a hollow body, said body having a flattened rectangular shape, a top edge, first and second bottom edges, first and second side edges, an interior chamber, first and second interior walls and a fluid inlet connector disposed adjacent said top edge;

a divider plate, said divider plate being sized and shaped to fit between said first and second interior walls, having first and second sides, each of said sides having at least one downwardly spiraling groove;

said at least one groove on said first side spiraling in a first direction and said at least one groove on said second side spiraling in an opposite, second direction;

said divider plate being attached between said first and second interior walls and dividing a path from said fluid inlet connector into two pathways;

each of said first and second bottom edges angling inwardly toward said divider plate and forming a channel, said channel being directed at said channel formed on an opposite side of said divider plate;

fluid, said fluid being supplied to said fluid inlet connector at a predetermined pressure; and whereby, when said fluid is introduced to said fluid inlet connector it will be divided into first and second streams, said first stream directed between said first interior wall and said divider plate and being spiraled in a first direction, said second stream directed between said second interior wall and said divider plate and being spiraled in a second, opposite direction, said first stream impinging upon said second stream at said bottom edges of said body and producing a mist with a lateral dispersion.

* * * * *